United States Patent [19]

Schneider

[11] Patent Number: 4,637,165

[45] Date of Patent: Jan. 20, 1987

[54] CORNER DEFLECTION ASSEMBLY

[75] Inventor: Alfred Schneider, Kreuztal, Fed. Rep. of Germany

[73] Assignee: Siegenia-Frank KG, Siegen, Fed. Rep. of Germany

[21] Appl. No.: 581,275

[22] Filed: Feb. 17, 1984

[30] Foreign Application Priority Data

Feb. 21, 1983 [DE] Fed. Rep. of Germany ... 8304739[U]

[51] Int. Cl.[4] ..... E05D 15/52

[52] U.S. Cl. ..... 49/192

[58] Field of Search ..... 49/192, 193

[56] References Cited

U.S. PATENT DOCUMENTS 3,994,093 11/1976 Mayer et al. ..... 49/192
4,339,892 7/1982 Ulbricht et al. ..... 49/192

FOREIGN PATENT DOCUMENTS 1269535 5/1968 Fed. Rep. of Germany .
2238489 2/1974 Fed. Rep. of Germany .
2509440 9/1976 Fed. Rep. of Germany .
2517367 10/1976 Fed. Rep. of Germany .
2706013 8/1978 Fed. Rep. of Germany .
3108212 9/1982 Fed. Rep. of Germany .

*Primary Examiner*—Kenneth Downey
*Attorney, Agent, or Firm*—Blodgett & Blodgett

[57] ABSTRACT

An assembly for the transfer of operating movement around the corner of a window or door, particularly tilt/turn closures, involves an angled casing, guiding a flexible deflection member, which connects the operating rods of the closure. An intermediary connecting member between the flexible deflection member and an operating rod forms a slide bolt, preferably a tilt-lock locking-slide, which is stiffened by a longitudinal batten. The batten fits in a slot on one leg of the angled casing. The sliding bolt engages the flexible member by means of a cam-and-recess. The batten stabilizes the flexible member when it is under compression. The assembly and the sliding bolt are shaped to allow insertion in grooves in the profiles which form the closure frame. A clamping piece holds one of the legs in the frame. Elements of the assembly assist in dispersing transverse forces which can cause binding.

19 Claims, 10 Drawing Figures

10
23
37'
22
37'
31
31
IV
IV
24
3
37
37
37"
37"
40
40
1
38
38
29
33"
33
34
35
39
39
40
25
35
VIII
VIII
40
4
X
X
30
14
12
28
21
IX
IX
19
33'
2
21
26
27
32

7
39
22
22'
33"
24
33
22"
3
5
37'
37
37"
6
38
8
23
10
9
6
40

7
37'
38
24
22
21
39
5
37"
6
8
40
22"
6
29
22'
33'
33

CORNER DEFLECTION ASSEMBLY

BACKGROUND OF THE INVENTION

This invention involves hardware for windows and doors. In particular, the innovation relates to the corner deflection assembly of a connecting-rod type lock which may be inserted into undercut, profiled grooves of the frame profiles of windows and doors of metal, plastic, or the like. The deflection assembly has an angled casing provided with a deflection member of flexible bands. Each of the legs of the angled casing guide has an intermediary connecting member connected with the deflection member. One of the legs has a smaller cross-sectional height than the other and the connection member guided by this leg serves at the same time as a sliding bolt. The deflection member is provided with a cam that is guided in an elongated slot in the outside of the leg.

A corner deflection assembly of this class is disclosed in German document DE-OS No. 25 09 440. In this previously disclosed corner deflection assembly, the cam serving as bolt member is mounted on the intermediary connecting member, so that it can be shifted only up to a position having a greater spacing from the apex of the angled casing and within a stretch lying in the longitudinal range of the leg.

The German document DE-OS No. 27 06 013 also discloses a corner deflection assembly of this class, in which the connection member forming the sliding bolt is the tilt-lock locking-slide of a tilt-turn fitting having a coupling recess into which a cam engages. This cam is detachably screwed to a slider of the deflection member, and engages the connection member through an elongated slot in the outside of the leg of the angled casing. This corner deflection assembly allows the tilt-lock locking-slide to be shifted, along with its tilt-lock tongue, beyond the apex of the angled casing and to mesh with a margin in a tilt-lock plate underneath the corner deflection assembly. This corner deflection assembly however can be inserted only into such frame profiles of metal, plastics, or the like in which the profiled area displaying the undercut, profiled groove has a bottom recess which is dimensioned at least large enough so that it is able totally to contain the leg of the angled casing (that has the flat cross sectional profile) underneath groove undercutting. Thus, the whole undercut, profiled groove is available for the accommodation of the connection member which forms the tilt-lock locking-slide, with the result that this has at least the same stability as the connecting or operating rods that can be coupled with it.

The German document DE-OS No. 22 38 489 has proposed to mount the corner deflection assembly outside of the undercut, profiled grooves of the frame profiles which contain the connecting or operating rods, and to guide the tilt-lock locking-slide past the outside on a leg of the angled casing of the corner deflection assembly in such a way that it embraces the leg on three sides and is guided by means of inwardly directed battens in lateral longitudinal slots of this leg. The coupling of the tilt-lock locking-slide with the connecting or operating rod is accomplished here independently of the coupling of the deflection member with it.

Finally, through the disclosure of German document DE-OS No. 25 17 367, it is already part of the art to make the legs of the angled casing of the corner deflection assembly narrow enough so that they can be embraced by profiled rail pieces of hat-shaped cross section, which serve (according to the disclosure of German document DE-OS No. 12 69 535) as holding elements for fixing the angled casing in the undercut, profiled grooves of the frame profiles. One of these forms, at the same time, an intermediary connecting member which acts as a locking slide.

In developing a connection member which serves simultaneously as sliding bolt, and that is sufficiently stable to cope with the demands made in use, it is necessary in prior corner deflection assemblies either to make the sliding bolt of high strength material (for example, high grade steel) or, if it is made by die-casting or injection-casting, to give it considerable wall thickness. This thickness must be provided both outside of the cross-section of the leg of the angled casing and also outside of the areas of the undercut, profiled grooves of the frame profiles. Consequently, a correspondingly larger mounting space is required at the frame profiles, which may not be readily available in every case.

It is, therefore, an outstanding object of the invention to provide a corner deflection assembly which requires only a minimal mounting area outside of the undercut profiled grooves of the frame profiles, even when using intermediary connecting members made by die-casting or injection-casting.

With this and other objects in view, as will be apparent to those skilled in the art, the invention resides in the combination of parts set forth in the specification and covered by the claims appended hereto.

SUMMARY OF THE INVENTION

Generally, the invention involves a corner deflection assembly in which a cam-guiding elongated slot in a leg of low cross-sectional height passes through up to the apex of the angled casing and is open there at the outside of a leg of greater cross-sectional height. The connection member forming the tilt-lock locking-slide engages, in the elongated slot of the leg, with a longitudinal batten molded into the underside, which batten is carried through up to the free end of the tongue of the tilt-lock.

The invention further involves an interruption of the longitudinal batten on the underside of the tilt-lock locking-slide at the zone of contact for a cam resting on the deflection member, the interruption forming the coupling recess for the cam.

The invention also involves the provision of a longitudinal batten which extends along the tilt-lock locking-slide over a longitudinal range that is longer (by an amount corresponding to the maximal sliding travel of the tilt-lock locking-slide) than the length of the leg (on the angled casing) which has the elongated slot.

In order to securely guide the tilt-lock locking-slide, the invention further provides that the slide has laterally spreading guide webs which can directly engage in the undercutting regions of the grooves of the frame profiles. These are provided at least on the longitudinal portion that projects, at every relatively shifted position, beyond the free end of the leg on the angled casing.

A secure and jam-free operation of the corner deflection assembly is achieved by a further provision of the invention: that the leg of the angled casing having the smaller cross sectional height displays laterally spreading battens or noses having cross sections that correspond to the undercutting regions of the grooves. Further, the leg with the greater cross-sectional height (whose width is considerably narrower than that of the outlet of its corresponding groove) can be locked in the profiled groove by means of a shim or clamp on each side. Each of these shims can be inserted in the spaced that remains between this leg (with its longitudinal furrows) and the undercutting regions of the groove. Further, a channel is formed into the battens or noses on the former leg of the angled piece, the groove open in each case toward the outlet of the groove, and extending, in its cross sectional width, from the leg up to the respective undercutting region of the profiled groove. The tilt-lock locking-slide is provided with two angled foot battens spreading from the underside to the leg, so that the leg is embraced by it from three sides. Thus, the foot battens engage in the channels and simultaneously undercut the frame parts which form the undercutting regions of the grooves.

A further aspect of the invention is that the angled foot battens of the tilt-lock locking-slide extend over a longitudinal region of the slide which lies within the longitudinal portion corresponding to the extent of the longitudinal batten on the underside while the laterally spreading guide webs adjoin and continue directly from these foot battens. Thus, the webs can engage (beyond the free end of the leg) in the undercutting regions of the grooves of the frame profiles.

Invention is also involved in the fact that the two shims are formed by the legs of a bow whose web embraces, on three sides, the leg having the greater cross-sectional height (at least in the region of its free end). Moreover, the legs of the shim (with their cross-sectional portions that lie outside of the undercutting regions of the grooves of the frame profiles) engage, in each case, between two battens or noses lying spaced and superposed in direction of the profile level of the leg at its lateral faces.

A further aspect of the invention involves the provision that the longitudinal batten on the underside of the slide bolt has smaller thickness in the section reaching from the engagement recess of the cam up to the free end of the tilt-lock tongue than it does in the section leading upwardly away from the engagement recess of the cam. Thus, the top section of the longitudinal batten is directly contiguous with the bottom of the elongated slot in the leg of the angled casing, while the lower section of the batten is adjacent to the outside of the deflection member, which lies free in the elongated slot.

The longitudinal batten acts, in this case, as stabilizing support for the deflection member, particularly during the movement of the deflection member taking place under compression. On the other hand, the longitudinal batten can also interact in a stabilizing manner with that leg of the angled casing which has the smaller cross sectional height. When transverse forces appear, the batten will supportingly rest against the bottom of the slot in the leg, while the tilt-lock locking slide finds its supporting abutment at the frame parts that form the groove undercutting regions.

BRIEF DESCRIPTION OF THE DRAWINGS

The character of the invention, however, may be best understood by reference to one of its structural forms, as illustrated by the accompanying drawings, in which.

Figure 1:
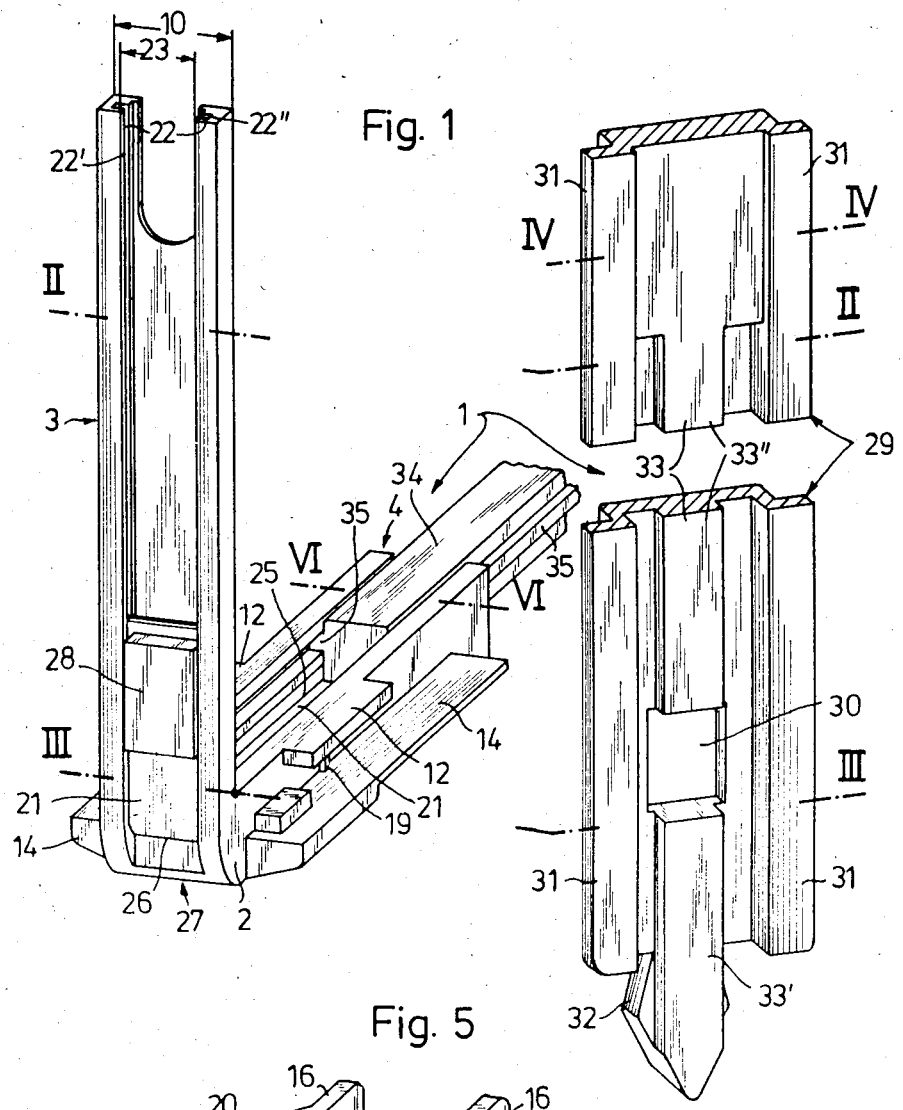
FIG. 1 is an exploded perspective view of a corner deflection assembly with an intermediary connection member which forms a tilt-lock locking slide, in which the corner deflection assembly per se can be seen from the front and the intermediary connection member is viewed from its rear side.

The corner deflection assembly 1, shown in FIG. 1 has an angled casing 2 which is formed in one piece by injection- or die-casting and which displays two legs 3 and 4 opposed to each other at essentially a right angle. The two legs 3 and 4 of the angled casing 2 have different cross-sectional heights. This may be seen especially clearly by comparing FIGS. 3 and 4 with FIG. 6. The leg 3 has a smaller cross sectional height than the leg 4. The cross sectional height of leg 3 is so dimensioned that the leg can be completely taken up in the undercut, profiled groove 5 and between the hook parts 6 which form the undercutting regions, of the frame parts 7, as can be clearly seen from FIGS. 2 and 3.

Figure 6:
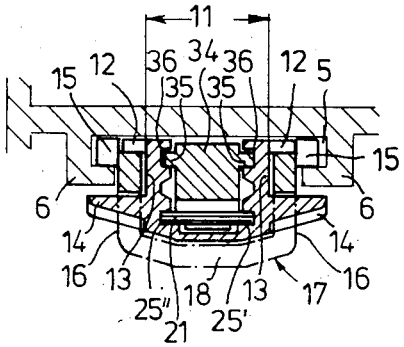
FIG. 6 is a cross-section taken along the line VI—VI in FIG. 1 through a corner deflection assembly which is installed and fixed by means of the shims according to FIG. 5.
Figure 10:
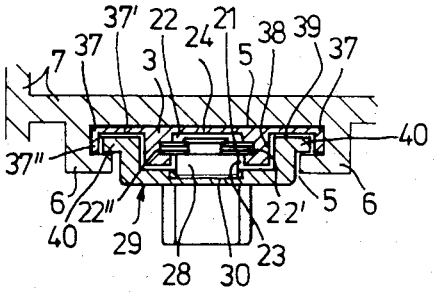
FIG. 10 is a cross-section taken along the line X—X in FIG. 7 of an installed corner deflection assembly.

On the other hand, the cross-sectional height of the leg 4 is so great that this leg projects between the hook parts 6 which form the undercutting regions of the profiled groove 5, with the leg projecting through the groove outlet 8 of the undercut, profiled groove 5, as shown in FIG. 6.

Figure 2:
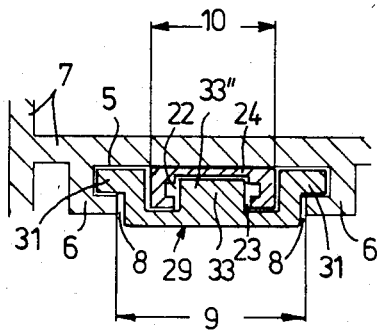
FIG. 2 is a cross-section taken along the line II—II in FIG. 1, through a corner deflection assembly which is mounted in a frame profile.
Figure 3:
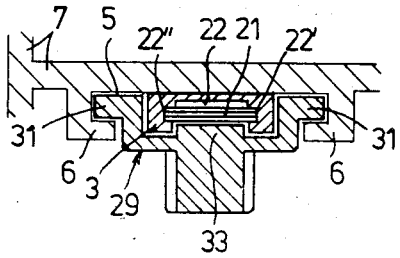
FIG. 3 is a cross-section taken along the line III—III in FIG. 1 of an installed corner deflection assembly.
Figure 4:
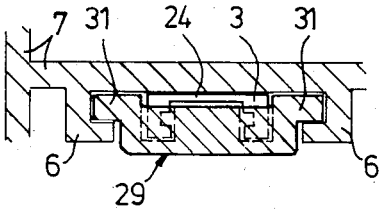
FIG. 4 is a cross-section taken along the line IV—IV in FIG. 1 of an installed corner deflection assembly.

The profile width 10 of leg 3 of the angled casing 2 is narrower than the width 9 of the groove outlet 8 between the hook parts 6 of the frame profile 7, as can be seen in FIGS. 2 and 3. The profile width 11 of the part of leg 4 of the angled casing 2 undercut by the profiled groove 5 is also dimensioned narrower than the width 9 of the groove outlet 8. Short batten sections 12 are joined the two lateral faces 13 of leg 4 and are flush with the inner face of the leg. The batten sections extend laterally so that, in their range, the leg 4 of the angled casing 2 has a width that approximately corresponds to the width 9 of the groove outlet 8. The thickness of the short batten section 12 is less than the internal height of the undercut, profiled groove 5 of the frame profiles 7 in the grooved undercutting regions Long battens 14 are located at the lateral faces of the region of the leg 4 which extends outside of the undercut, profiled groove 5. These battens extend over the major portion of the length of the leg 4 and give to the leg, at this point, a total width which corresponds approximately to the internal width of the undercut, profiled groove 5 in the groove undercutting regions.

Figure 5:
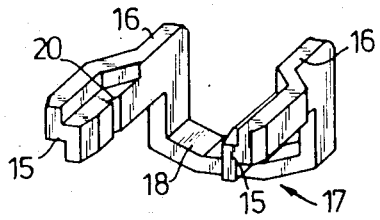
FIG. 5 is a perspective view of a bow forming the shims for a corner deflection assembly according to the embodiment of FIG. 1.

The leg 4 of the angled casing 2 of the corner deflection assembly 1 is fixed (for example, at the frame profile 7 which forms a lower horizontal wing spar) by means of two shims or clamping pieces 15 which are developed at the ends of the two legs 16 of an approximately U-shaped bow 17, shown in FIG. 5. The two batten shaped shims 15 have towards each other a "mirror-inverted" configuration and a somewhat "S" or "Z" shaped cross sectional form throughout, as can be seen from FIGS. 5 and 6.

On the one hand, the two shims 15 continuously engage the leg 4 between the batten sections 12 and the battens 14 on the lateral faces of the leg. On the other hand, they undercut and engage (by the side of the batten sections 12), the frame parts 6 of the frame profiles which form the groove undercutting regions, and thereby positively fix the leg 4 of the angled casing 2 in the undercut, profiled groove 5. The web 18 of the approximately U-shaped bow 17 is formed so that it embraces the leg 4 of the angled casing (at least in the region of its free end) on three sides. This is best seen in FIG. 6.

Furthermore, to assure that the shims 15 are fixed in their engaging position without moving into a longitudinally wedged-shaped configuration, saw toothed notch cams 19 are provided, at the lateral faces 13 of leg 4. The cams come into operative connection with notch indentations 20 located in those regions of the inner surfaces of the shims 15 which engage between the batten sections 12 and the battens 14.

A flexible deflection member 21 consisting of spring steel bands or strips runs in the leg 3 of the angled casing 2 of the corner deflection assembly 1 in a channel 22 which consists of two grooves 22' and 22" bordering on an externally open, elongated slot 23. Each groove embraces on three sides the longitudinal edges of the deflection member 21 and holds the deflection member at a certain distance from the bottom 24 of the leg 3, as can be seen from FIGS. 2 and 3. A similar channel 25 with two grooves 25' and 25" embracing on three sides the longitudinal edges of the deflection member 21 is located also in leg 4 of the angular casing 2, as clearly shown in FIG. 6.

The channels 22 and 25 extend in a straight line in the legs 3 and 4 of the angular casing 2 of the corner deflection assembly 1 and are connected in the corner region of the angled casing via a bow-shaped channel section 26. Only the bottom edge of the "run-in" opening of this channel, which joins up with the channel 22, is visible in FIG. 1. The bow shaped channel section 26 extends between the two channels 22 and 25 via and an arc angle of 90°.

It is important for this design of corner deflection assembly 1 that the elongated slot 23 at the outside of leg 3 extends practically without interruption over the whole length of leg 3, extending through to the apex 27 of the angled casing 2. There, the slot opens up towards the outside of leg 4 as shown in FIG. 1. A coupling cam 28 is guided in this elongated slot 23. The cam is mounted at one end of the flexible deflection member 21. By this means, an intermediary connecting member 29 can be brought (via a coupling recess 30) into a detachable, positive locking engagement with the flexible deflection member 21. The intermediary connecting member 29 is designed as a sliding bolt, preferably as the tilt-lock type "lock-slide" of a rotary swivel mounting (not shown) and has a cross-sectional configuration, such that it embraces the leg 3 of the angled casing 2 of the corner deflection assembly 1 from the outside on three sides. The intermediary connecting member further positively undercuts the angled or hook-shaped frame parts 6 which form the groove undercutting regions, by means of two laterally spreading guide webs 31. Both of these relationships are clearly illustrated in FIGS. 2, 3, and 4.

The intermediary connecting member 29 which is formed and acts as a sliding bolt (in particular, as a tilt-lock locking-slide) is considerably longer than the leg 3 of the angled casing 2 of the corner deflection assembly 1 and has, at one end, a coupling tab (not depicted) through which it can be connected, e.g., by means of a screw member, with a coupling hole of a connecting or operating rod (also not shown). At its other end, the intermediary connecting member 29 has a lock tongue 32, preferably a tilt-lock tongue, which is so arranged and designed that it can be pushed a considerable distance beyond the apex region 27 of the angled casing 2 of the corner deflection assembly 1.

To ensure that the intermediary connecting member 29 which functions as slide bolt, preferably as the tilt-lock locking-slide, has a high natural stability even when it is produced as a shaped part through injection- or die-casting, it is provided with a longitudinal batten 33 molded onto the underside, which batten has dimensions such that it can engage in the elongated slot 23 of the leg 3 of the angled casing 2, as is clearly shown in FIGS. 2 and 3.

The longitudinal batten 33 extends on the underside of the intermediary connecting member 29 up to the free end of the bolt tongue 32 (which is preferably a tilt-lock tongue) and is interrupted only in the region of the coupling recess 30 which forms the catch for the coupling cam 28. The batten extends on the intermediary connecting member 29 over a longitudinal section that is longer, by an amount corresponding to its maximal sliding travel, than the length of the leg 3 of the angled casing 2 which has the elongated slot 23.

A comparison of FIGS. 2 and 3 shows that the longitudinal batten 33 on the underside of number 29 has a lesser thickness in the section 33' extending from the coupling recess 30 for the coupling cam 28 up to the free end of the bolt tongue 32, than it does in the section 32' extending from the coupling recess 30 in an upward direction (away from the tongue). Because of this, section 33' of the longitudinal batten 33 directly overlaps and is contiguous with the bottom 24 of leg 3 as shown in FIG. 2. On the other hand, the lower section 33' of the batten borders on the outer section of the part of the flexible deflection member 21 which lies exposed in the elongated slot 23, as is clearly shown in FIG. 3.

Clearly, the section 33' of the longitudinal batten 33, directly engaging and co-operating with the bottom 24 of leg 3 of the angled casing 2, is capable of taking over the function of a supporting element which securely introduces the transverse forces exerted upon leg 3 into the hook parts 6 of the frame, which parts form the groove undercutting regions. On the other hand, section 33' of the longitudinal batten 33 acts as supporting guidance for the outer section of the part of the flexible deflection member 21 that is exposed in the elongated slot 23, and thereby protects this against undesirable "buckling out" when it stands under the affect of compressive forces during its movement.

Regarding FIGS. 1 and 6, it should be mentioned that the second intermediary connecting member 34 is constantly in engagement with the flexible deflection member 21. This second intermediary connection member is guided in the leg 4 of the angled casing 2 via longitudinal battens 35 which engage the leg in corresponding longitudinal grooves 36.

The particular embodiment of a corner deflection assembly 1 according to the present invention illustrated in the FIGS. 7 thru 10 has basically the same design as the particular embodiment according to FIGS. 1 thru 6. One difference consists in the additional feature that the leg 3 of the angled casing 2 of the corner deflection assembly 1 (the leg which has the lower cross sectional height) has laterally spreading battens or noses 37 of angled or L-shaped cross section. These laterally spreading battens or noses fit into the groove undercutting regions defined by the angled or hook shaped parts 6 of the frame. This feature is seen in cross section in FIGS. 8 thru 10. While one flange 37′ of the battens or noses 37 lies always in the same plane as the bottom 24 of leg 3, the other flange 37″ extends at a right angle thereto and forms the external longitudinal limitation of the battens or noses 37. Between each of the longitudinal lateral faces 38 of leg 3 and each of the laterally spreading battens or noses 37, a channel 39 is defined which is opened toward the groove outlet 8 of the undercut, profiled groove 5. Each such channel extends (in its cross sectional width) from the longitudinal lateral faces 38 of leg 3 up to the respective groove undercutting region of the profiled groove 5. The intermediary connecting member 29 of FIG. 7 which functions as a slide bolt (or preferably as a tilt-lock locking-slide), is provided, over the length of the longitudinal batten 33 molded onto the underside, with angled foot battens spreading away from the side facing leg 3 (the underside), so that the leg 3 is embraced by the intermediary connecting member 29 on three sides. These foot battens 40 thereby engage in the channels 39 and undercut the hook parts 6 of the frame, which form the groove undercutting regions, as can readily be seen in FIGS. 8 thru 10.

Figure 7:
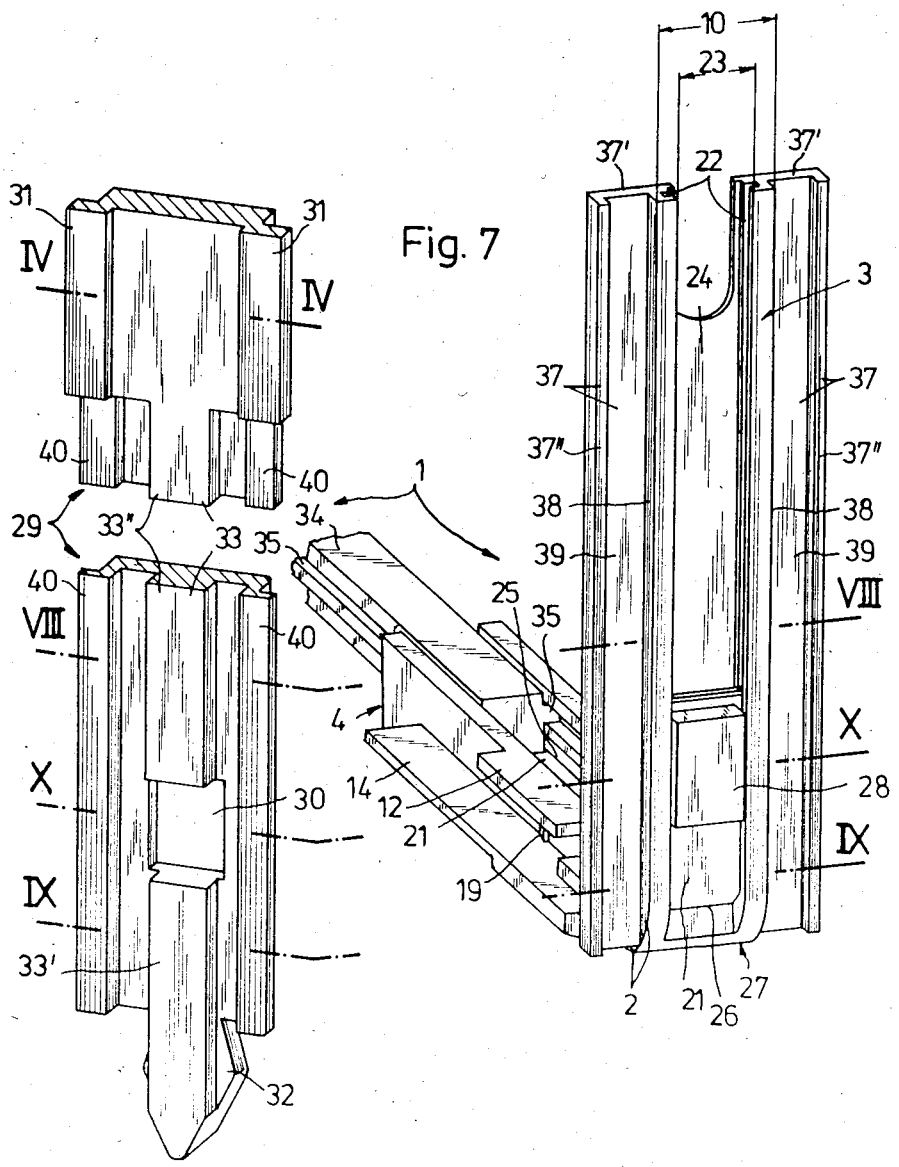
FIG. 7 illustrates another embodiment of a corner deflection assembly in a presentation corresponding (in a mirrored manner) to that of FIG. 1.
Figure 8:
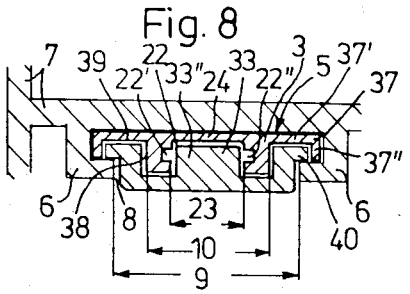
FIG. 8 is a cross-section taken along the line VIII—VIII in FIG. 7 of an installed corner deflection assembly, FIG. 9 a cross-section taken along the line IX—IX in FIG. 7 of an installed corner deflection assembly.
Figure 9:
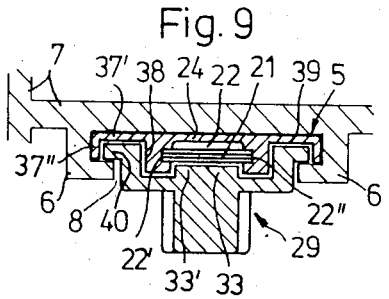

On the intermediary connecting member 29 of FIG. 7, the laterally spreading guide webs 31 which directly undercut the hook parts 6 of the frame are located only in that longitudinal region that lies beyond the free end of leg 3 of the corner deflection 1 for any possible sliding position of the intermediary connecting member 29. The legs of the guide webs 31, however, directly adjoin the foot battens 40 at a point in an upward direction (away from the tongue 32), as can be seen in FIG. 7.

The embodiment of the corner deflection assembly 1 according to FIGS. 7 thru 10 has this advantage over the one of FIGS. 1 thru 6: that the laterally spreading battens or noses 32 are capable of transmitting transverse forces acting on the leg 3 of the angular casing 2 of the corner deflection 1 directly into the frame parts 6 which form the groove undercutting region of the undercut, profiled groove 5. Thus, these transverse forces are prevented from acting on the intermediary connecting member 29 which forms the slide bolt (preferably longitudinal region of the intermediary connecting member 29 (with the addition of a length corresponding to the maximal sliding travel of the member 29), the leg would be provided with the angular foot battens, while the remaining longitudinal region would be equipped with the laterally spreading guide webs 31.

The corner deflection assembly 1 of FIGS. 7 thru 10 can also be designed so that the intermediary connecting member 29 which forms the slide bolt (or, preferably, the tilt-lock locking-slide) is provided with inwardly narrowed dove-tailed profile battens instead of the outwardly angular foot battens 40. These dove-tailed profile battens would then be assigned corresponding inclined planes on the battens or noses 37 which define the channels 39. Such dove-tailed profile battens can be slid onto these inclined planes in a longitudinal direction. The coupling connection of the intermediary connecting member 29 with the flexible deflection member 21 would, in this case, preferably be accomplished via a screw element which is screwed into a threaded bore in the intermediary connecting member 29. This would then project with a pin into a hole in the deflection member 21.

Corner deflection assemblies of the kind illustrated, described and claimed can also be used for the locking of knockout devices with the wing of a rotary tilt window or the like when this is in the closing position or is to be brought into rotary opening position. It is also possible to use these corner deflection assemblies on Bascule bolts with oppositely directed bar exclusion, which are often used on windows and doors.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Corner deflector assembly of a connecting rod type lock, insertable into undercut, profiled grooves of the frame profiles of windows and doors of metal, plastic, or the like, having an angled casing enclosing a deflection member of flexible bands, the angled casing having a first leg and a second leg, each of the legs of the angled casing guiding an intermediary connection member connected with the deflection member, in which the first leg has a smaller cross sectional height than the second leg, and in which the intermediary connecting member guided by this first leg serves at the same time as a sliding bolt and displays a cam which is guided in an elongated slot at the outside of the first leg, characterized by the fact that:

the elongated slot (23) guiding the cam (28) passes through the first leg (3) to the apex (27) of the angled casing and is opened at the outside of the second leg (4) and that the intermediary connecting zone of contact of the cam (28) which rests on the deflection member (21).

3. Corner deflection assembly as recited in claim 1, wherein:

the sliding bolt (29) is provided with laterally spreading guide webs 31 on a longitudinal portion which projects, at every relative sliding position, beyond the free end of the first leg (3) of the angled casing (2), said webs adapted to directly engage in the groove undercutting regions (6) of the frame profiles (7).

4. Corner deflection assembly as recited in claim 1, wherein:

the first leg (3) of the angled casing (2) is provided with laterally spreading battens (37) whose cross section corresponds to that of the groove undercutting regions (6); and wherein the second leg (4), having a width considerably narrower than the width (9) of the outlet (8) of its corresponding groove, can be locked in position in the profiled groove (5) by means of a two shims (15), one on each side, each shim adapted to be inserted into the space that remains between this second leg (4), which is provided with lateral longitudinal furrows, and the groove undercutting regions (6); and wherein the battens or noses (37) at the first leg (3) of the angled casing (2) are each provided with one channel (39) which is opened towards the groove outlet (8) and which extends, in its cross sectional width, from the first leg (3) up to the respective groove undercutting regions (6) of the profiled groove (5); and wherein the sliding bolt (29) is provided with two angled foot battens (40) spreading out from the underside, so that the first leg (3) is embraced by the sliding bolt on three sides, said foot battens (40) engaging in the channels (39) and simultaneously undercutting the frame parts (6) which form the groove undercutting regions.

5. Corner deflection assembly as recited in claim 1, wherein:

the longitudinal batten (33) on the underside of the sliding bolt has a smaller thickness in the section (33′) which extends from the zone of contact (30) of the cam (28) up to the free end of the bolt tongue (32) than in the section (33″) which leads from the zones of contact (30) of the cam (28) upwardly away, and wherein the upper section (33″) of the longitudinal batten (33) is directly contiguous with the bottom (24) of the elongated slot (23) in the first leg (3) while the lower section of the batten is adjacent to the outside portion of the deflection member (21) which lies free in the elongated slot (23).

6. Corner deflection assembly as recited in claim 2, wherein:

the longitudional batten (33) on the underside of the sliding bolt (29) extends over a longitudinal range which is longer, by an amount corresponding to the maximal sliding travel of the sliding bolt (29) than the length of the first leg (3) of the angled casing (2) which has the elongated slot (23).

7. Corner deflection assembly as recited in claim 2, wherein:

the sliding bolt (29) is provided with laterally spreading guide webs (31), on a longitudinal portion which projects, at every relative sliding position, beyond the free end of the first leg (3) of the angled casing (2), said webs adapted to directly engage in the groove undercutting regions (6) of the frame profiles (7).

8. Corner deflection assembly as recited in claim 2, wherein:

the first leg (3) of the angled casing (2) is provided with laterally spreading battens (37) whose cross section corresponds to that of the groove undercutting regions (6); and wherein the second leg (4), having a width considerably narrower than the width (9) of the outlet (8) of its corresponding groove, can be locked in position in the profiled groove (5) by means of a shim (15) on each side, each shim adapted to be inserted into the space that remains between this second leg (4), which is provided with lateral longitudinal furrows, and the groove undercutting regions (6); and wherein the battens (37) at the first leg (3) of the angled casing (2) are each provided with one channel (39) which is opened towards the groove outlet (8) and which extends, in its cross-sectional width, from the first leg (3) up to the respective groove undercutting regions (6) of the profiled groove (5); and wherein the sliding bolt (29) is provided with two angled foot battens (40) spreading out from the underside, so that the first leg (3) is embraced by the sliding bolt on three sides, said foot battens (40) engaging in the channels (39) and simultaneously undercutting the frame parts (6) which form the groove undercutting regions.

9. Corner deflection assembly as recited in claim 2, wherein:

the longitudinal batten (33) on the underside of the sliding bolt has a smaller thickness in the section (33′) which extends from the zone of contact (30) of the cam (28) up to the free end of the bolt tongue (32) than in the section (33″) which leads from the zone of contact (30) of the cam (28) upwardly away; and wherein the upper section (33″) of the longitudinal batten (33) is directly contiguous with the bottom (24) of the elongated slot (23) in the first leg (3) while the lower section of the batten is adjacent to the outside portion of the deflection member (21) which lies free in the elongated slot (23).

10. Corner deflection assembly as recited in claim 3, wherein:

the sliding bolt (29) is provided with laterally spreading guide webs (31), on a longitudinal portion which projects, at every relative sliding position, beyond the free end of the first leg (3) of the angled casing (2) said webs adapted to directly engage in the groove undercutting regions (6) of the frame profiles (7).

11. Corner deflection assembly as recited in claim 3, wherein:

the first leg (3) of the angled casing (2) is provided with laterally spreading battens (37) whose cross section corresponds to that of the groove undercutting regions (6); and wherein the second leg (4) having a width considerably narrower than the width (9) of the outlet (8) of its corresponding groove, can be locked in position in the profiled groove (5) by means of a shim (15) on each side, each shim adapted to be inserted into the space that remains between this second leg (4), which is provided with lateral longitudinal furrows, and the groove undercutting regions (6); and wherein the battens (37) at the first leg (3) of the angled casing (2) are provided with one channel (39) which is opened towards the groove outlet (8) and which extends, in its cross-sectional width, from the first leg (3) up to the respective groove undercutting regions (6) of the profiled groove (5); and wherein the sliding bolt (29) is provided with two angled foot battens (40) engaging in the channels (39) and simultaneously undercutting the frame parts (6) which form the groove undercutting regions.

12. Corner deflection assembly as recited in claim 3, wherein:

the longitudinal batten (33) on the underside of the sliding bolt has a smaller thickness in the section (33') which extends from the zone of contact (30) to the cam (28) up to the free end of the bolt tongue (32) than in the section (33") which leads from the zone of contact (30) of the cam (28) upwardly away, and wherein the upper section (33") of the longitudinal batten (33) is directly contiguous with the bottom (24) of the elongated slot (23) in the first leg (3) while the lower section of the batten is adjacent to the outside portion of the deflection member (21) which lies free in the elongated slot (23).

13. Corner deflection assembly as recited in claim 3, wherein:

the first leg (3) of the angled casing (2) is provided with laterally spreading battens (37) whose cross section corresponds to that of the groove undercutting regions (6); and wherein the second leg (4) having a width considerably narrower than the width (9) of the outlet (8) of its corresponding groove, can be locked in position in the profiled groove (5) by means of a shim (15) on each side, each shim adapted to be inserted into the space that remains between this second leg (4), which is provided with lateral longitudinal furrows, and the groove undercutting regions (6); and wherein the battens (37) at the first leg (3) of the angled casing (2) are provided with one channel (39) which is opened towards the groove outlet (8) and which extends, in its cross-sectional width, from the first leg (3) up to the respective groove undercutting regions (6) of the profiled groove (5); and wherein the sliding bolt (29) is provided with two angled foot battens (40) engaging in the channels (39) and simultaneously undercutting the frame parts (6) which form the groove undercutting regions.

14. Corner deflection assembly as recited in claim 5, wherein:

the angular foot battens (40) of the sliding bolt (29) extend over a longitudinal region thereof which lies within a longitudinal portion corresponding to the extent of the longitudinal batten (33) on the underside; and wherein the laterally spreading guide webs (31) adjoin and continue directly from the foot battens (40) whereby the webs are adapted to be inserted beyond the free end of the first leg (3) into the groove undercutting regions (6) of the frame profiles.

15. Corner deflection assembly as recited in claim 5, wherein:

each of the two shims (15) is formed by a leg (16) of a bow (17) having a web (18) which embraces, on three sides, the second leg (4) in the region of the free end of the second leg and wherein the cross-sectional portions of the legs (16) of the bow that lie outside of the groove undercutting regions (6) of the frame profiles (7) engage between two spaced and superposed noses (12, 14) in the direction of the profile level of the second leg (4) at its longitudinal lateral face (13).

16. Corner deflection assembly as recited in claim 5, wherein:

the longitudinal batten (33) on the underside of the sliding bolt has a smaller thickness in the section (33') which extends from the zone of contact (30) to the cam (28) up to the free end of the bolt tongue (32) than in the section (33") which leads from the zone of contact (30) of the cam (28) upwardly away, and wherein the upper section (33") of the longitudinal batten (33) is directly contiguous with the bottom (24) of the elongated slot (23) in the first leg (3) while the lower section of the batten is adjacent to the outside portion of the deflection member (21) which lies free in the elongated slot (23).

17. Corner deflection assembly as recited in claim 5, wherein:

each of the two shims (15) is formed by a leg (16) of a bow (17) having a web (18) which embraces, on three sides, the second leg (4) in the region of the free end of the second leg and wherein the cross-sectional portions of the legs (16) of the bow that lie outside of the groove undercutting regions (6) of the frame profiles (7) engage between two spaced and superposed noses (12, 14) in the direction of the profile level of the second leg (4) at its longitudinal lateral face (13).

18. Corner deflection assembly as recited in claim 5, wherein:

the longitudinal batten (33) on the underside of the sliding bolt has a smaller thickness in the section (33') which extends from the zone of contact (30) to the cam (28) up to the free end of the bolt tongue (32) than in the section (33") which leads from the zone of contact (30) of the cam (28) upwardly away, and wherein the upper section (33") of the longitudinal batten (33) is directly contiguous with the bottom (24) of the elongated slot (23) in the first leg (3) while the lower section of the batten is adjacent to the outside portion of the deflection member (21) which lies free in the elongated slot (23).

19. Corner deflection assembly as recited in claim 5, wherein:

the longitudinal batten (33) on the underside of the sliding bolt has a smaller thickness in the section (33') which extends from the zone of contact (30) to the cam (28) up to the free end of the bolt tongue (32) than in the section (33") which leads from the zone of contact (30) of the cam (28) upwardly away, and wherein the upper section (33") of the longitudinal batten (33) is directly contiguous with the bottom (24) of the elongated slot (23) in the first leg (3) while the lower section of the batten is adjacent to the outside portion of the deflection member (21) which lies free in the elongated slot (23).

* * * * *